United States Patent [19]

Trillo Martinez et al.

[11] Patent Number: 5,018,543

[45] Date of Patent: May 28, 1991

[54] PORTABLE SHAVING KIT

[75] Inventors: Federico Trillo Martinez; Jose M. Gargallo Jimeno, both of Madrid, Spain

[73] Assignee: Creatividad Y Desarrollo, S.A. (Creatyde, S.A.), Barajas, Spain

[21] Appl. No.: 467,840

[22] Filed: Jan. 19, 1990

[30] Foreign Application Priority Data

Jan. 19, 1989 [ES] Spain ..... 8900190

[51] Int. Cl.[5] ..... A45D 27/22

[52] U.S. Cl. ..... 132/291; 132/289; 132/290; 30/57; 30/66; 30/90

[58] Field of Search ..... 132/287, 290, 291, 292; 30/41, 47, 57, 58, 66, 90

[56] References Cited

U.S. PATENT DOCUMENTS

| | | | |
|---|---|---|---|
| 975,535 | 11/1910 | Knaster | 30/66 |
| 1,164,979 | 12/1915 | Benko | 132/290 |
| 1,369,012 | 2/1921 | Dynowsky | 132/290 |
| 2,818,872 | 1/1958 | Wang | 132/289 |
| 4,141,445 | 2/1979 | Korich | 132/289 |
| 4,433,483 | 2/1984 | Lazarus | 30/41 |
| 4,908,945 | 3/1990 | Jacobson | 30/41 |

FOREIGN PATENT DOCUMENTS

| | | | |
|---|---|---|---|
| 2537911 | 6/1984 | France | 30/41 |
| 172570 | 12/1921 | United Kingdom | 132/289 |

*Primary Examiner*—John J. Wilson
*Assistant Examiner*—Frank A. LaViola
*Attorney, Agent, or Firm*—Kuhn and Muller

[57] ABSTRACT

It consists of a main body, preferably of cylindrical form, over whose ends the lather spray container and the aftershave or lotion spray container for aftershave use are introduced, each end being closed by its own cap. The cap which closes the lather spray container unwinds at one side by a body parallel to the main body, resembling the ball-point pen fastener in function. The body incorporates shaving heads on both sides and in front a visual mirror, either plane or concave. The connection system between heads and main body of the unit is a detachable male-female connection of the heads.

6 Claims, 4 Drawing Sheets

PORTABLE SHAVING KIT

BACKGROUND AND FIELD OF THE INVENTION

The object of the present patent invention is a shaving unit and shaving tools, all incorporated in a single element of small dimensions, which includes essential characteristics of novelty, practical usefulness, and efficacy in its function, presenting considerable advantages over what is known to date in the personal care area and over what exists in the corresponding male cosmetics sector.

With reference to the current state of the art, U.S. Pat. No. 4,433,483, issued on Feb. 28, 1984, should be pointed out, consisting of a shaving unit formed by a handle, which in its turn is a bottle or spray lather dispenser, the outlet nozzle being closed above by a cap, which in its turn and by means of a projecting end provides fastening to the body of the head of the shaving unit.

Said unit thus represented lacks many elements or functions pertaining to shaving, such as aftershave massage, easy transport, which is very difficult because of its characteristics, having a single head, etc. Consequently, and recognizing each and all of the deficiencies mentioned, as well as others which have not been indicated, the object of the present patent of invention was developed through gargeted researches; it incorporates a number of elements and tools suitable for any function belonging to shaving.

SUMMARY OF THE INVENTION

The development of an element such as the present invention was required by the travel needs of more and more people of all kinds, preferably applied to military travels, whether on routine or wartime maneuvers, travels in business trips of managers, executives, salesmen, etc., in which they are called on during their daily work to preside over, prepare or attend interviews relating to their particular work, a necessary neatness and propriety being required in each of those interviews. This personal care unit makes it possible to shave at any moment and anywhere without space complications by only uncovering a simple and manageable manual container, which contains everything necessary for satisfying this need within it.

This new consumer object, included among useful objects to be used and thrown away, has a capacity of about 8 to 10 applications, and it takes up almost no space in travel bags, briefcases, in jacket pockets, if desired, since its form resembles that of a pocket labeler.

The hollow and cylindrical handle container of this shaving unit is characterized by its three main functions, as follows: being the handle of the shaving unit, being the blade holder for its use, also being the container for the lather and aftershave spray packages for the aftershave function. Both packages are located in line within said handle, the base of one touching the base of the other. The valve of the lather container and the massage head thus emerge separately by the two opposite mouths of the handle, the corresponding closure caps being connected at the ends of the latter.

The cap covering the massage dispenser only has the function of protecting the pulser of the sprayer of said product.

The cap covering the pulser of the lather container valve additionally performs other functions, among them that of being the bearer of two shaving heads, that of bearing and supporting a mirror on its front surface, and that of being designed as a pocket hanger.

In its turn, the handle includes a connection in its upper end for fastening the head, and this consequently remains in shaving position, two different possible versions being offered: a first version consists of two small parallel tracks (male) coinciding in size with the two channels or tracks (female) which each head has for the purpose of being fastened at this point.

The other version is designed so that the clip located in the upper end of the extension consists of a hollow cylinder sectioned along its entire path, i.e., from end to end, with an opening on both sides; the solid cylinder attached to the head passes through its interior. However, in practice the correct expression would be that, "It is the female cylinder which passes above the surface of the solid cylinder, since the latter remains without movement, whereas the other one does not initiate and perform the operation of the entrainment of the head."

The base of the solid cylinder in the longitudinal zone closest to same and in its entire path is narrower than the longitudinal section made in the above mentioned female cylinder, so that it moves when the handle is pulled in a side direction. The small difference between the width and the thickness of the two cylinders furthermore permits a limited circular movement between both for the purpose of facilitating a slight balancing of the head.

In its middle point, the solid cylinder contains a concave peripheral ring which, when it coincides with the other convex ring, which takes place inside the other cylinder, forms an adjustment point.

The removal or assembling of the head is done by a direct operation made with the handle, i.e., without the need of an intervention by the fingers.

On its two exterior sides, the upper cap contains fissures designed for attachment of the heads, where they are deposited or placed directly with any of the pliers contained in the handle, this depending on the version adopted in each case. Both the removal and the placement of the head in its specified fissure is done by means of a slide, or in other words, by sliding it from one end to the other; its bottom offers a slight resistance or pressure where it is held by pressure.

The special form of this cap determines the location of the two heads in it in their rest position, so that it can be used as a pocket hanger when one part of same is presented parallel to and separated from the handle. On its front surface, moreover, it presents a smooth surface prepared for placement of a mirror in it which, although its reduced dimensions do not permit the option of seeing the complete face, does permit observation of the shaving area, although the possibility also exists or said mirror to be concave, increasing the area.

In addition to the quality presented by the very little space which this shaving unit occupies in any traveling bag or personal care closet shelf, it presents the advantage that it is not possible to forget any of the articles or products which make up the unit necessary for shaving, since all of them make up the unit.

The following detailed description relates to the figures contained on the attached pages of drawings, which are presented as examples without any limiting character, since practice may lead to recommending any modification in form or in the different materials to be used in its manufacture without altering the essential features of the invention; the design which we consider most suitable in conformity with the foregoing remarks has been presented.

FIG. 4 represents a view from a lower location of the cap used as pocket hanger.

Figure 5:
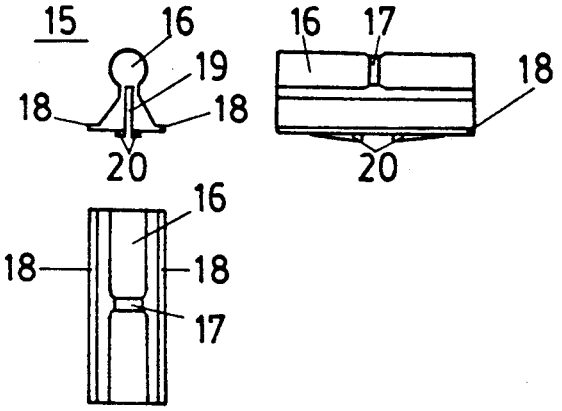

FIG. 5 presents the three representative views, elevated, horizontal projection and profile, of the connecting element between the head and the handle of the shaving unit.

Figure 6:
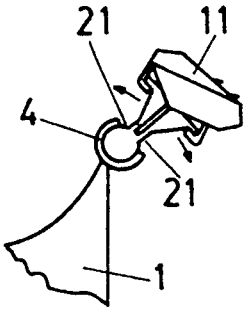

FIG. 6 shows a profile view of the connection by means of the element of FIG. 5.

Figure 7:
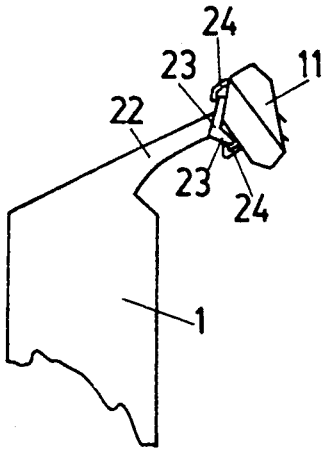

FIG. 7 represents a profile view identical to that of FIG. 6, in which its connection takes place by means of two arms at an angle similar to that of a connection in extended form.

Figure 1:
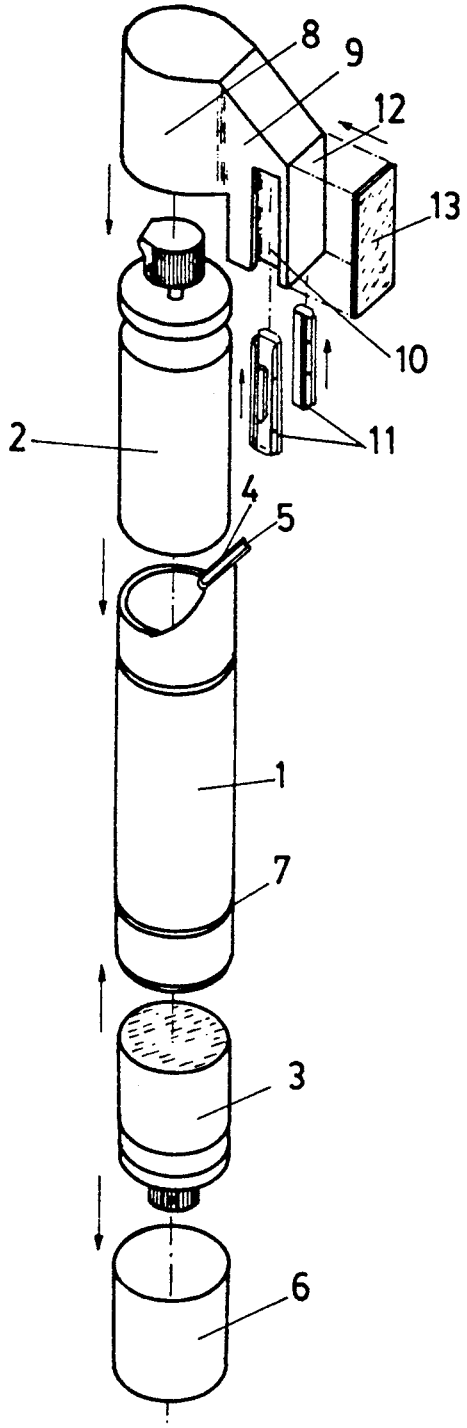
FIG. 1 represents the unit of the invention in disassembled form.

FIG. 1 shows the design of the disassembled shaving unit of the invention, first of all presenting the main body of unit 1 designed in extended hollow form, into whose interior and by both ends lather spray container 2 and aftershave or lotion spray 3 are introduced. This central body 1 terminates at the side at one of its ends by means of connection guide 4 in hollow cylindrical form and with cross opening (5), through which the head of the shaving unit will be introduced.

Both ends of both the massage lather and the aftershave lotion spray are closed by their individual covers, lower cover 6 having the function of covering the lotion or aftershave spray quite simply in cylindrical form, adjusting in penetration against ring or flange 7.

On the other hand, upper cover 8 of the unit, in addition to a definitive closing of the end of the unit, furthermore provides another series of characteristic functions, first of all that of extending to the side into body 9 parallel to container body 1, leaving a hollow between both suitable for use as an attachment element, similar to the fastening of ball point pens or similar objects.

Fissures 10 over which shaving heads 11 can be inserted under pressure are located on both sides of this cap extension body.

Mirror 13 is optionally located on front face 12 of this cap; it facilitates observation of the shaving areas by the user, said mirror being of plane form in order not to deform the image, or on the other hand, by adopting concave mirrors, a deformation of the image results, but in consequence a greater area of the image of the face or portion of the face or shaving area is attained; this mirror is surrounded along its side edges by a protective plastic frame.

Figure 2:
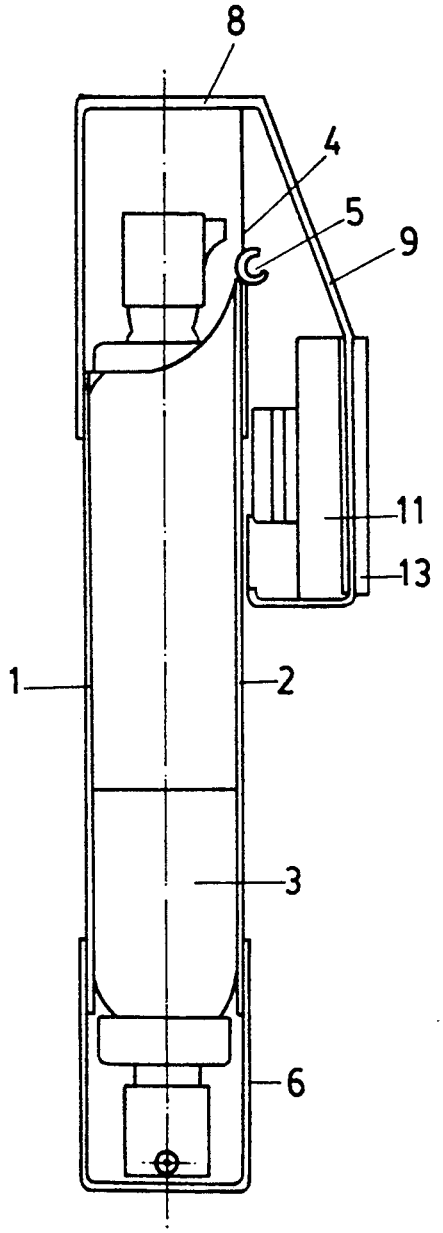
FIG. 2 shows a sectioned elevated view of the unit of the invention.

FIG. 2 presents a sectioned elevated view of the unit of the invention, in which central body or envelope 1 is observed, in whose interior lather spray container 2 and aftershave lotion or massage spray container are placed by positioning under pressure. The end of the lotion spray is covered by cap 6 positioned under pressure until it strikes against a ring which makes up the side of container body 1.

Meanwhile, upper cap 8 or closure cap of the lather spray head extends to the side by means of body 9 parallel to body base 1, forming a fastening unit of the same form as in the case of ball point pens or similar objects. Shaving heads 11 are located on both sides of the extension of cap 8, whereas observation mirror 13 is located on the front face of said cap.

The fastening connection of the heads is located as an extension of main body 1 at its end and covered with cap 8, formed by hollow cylindrical portion 4 with oblique side opening 5 through which the connection fixed to the head will be introduced, and which will be described in greater detail in the following figures.

Figure 3:
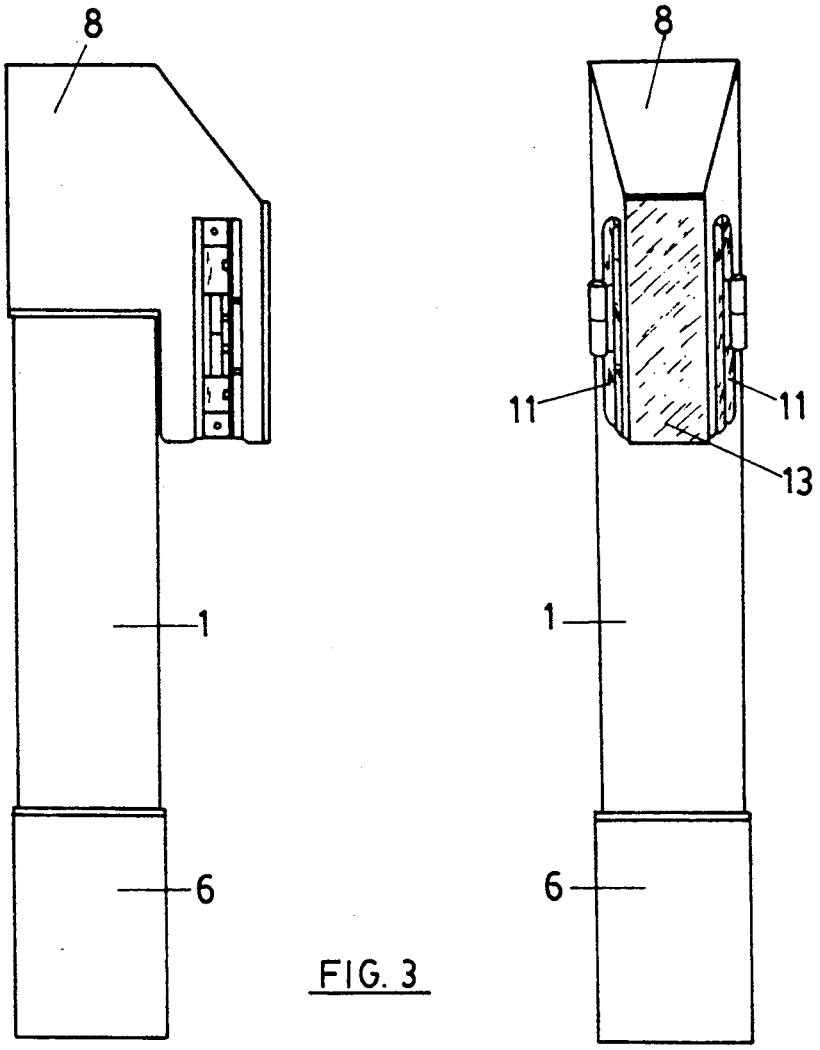
FIGS. 3 and 4 represent an elevated view and profile of the assembled unit of the invention.

FIG. 3 shows an elevated and profile view of the assembled unit of the invention, formed by extended central body 1 closed at both ends by caps 6 and 8, shaving heads 11 as well as front mirror 13 being located in it.

Figure 4:
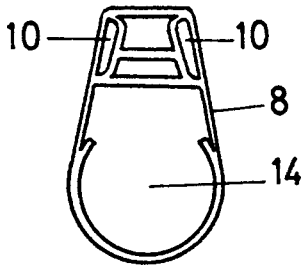

FIG. 4 presents a view from a lower level of upper closure cap 8, space 14 being intended for accomodation of body end 1, whereas spaces 10 are used for accomodating shaving heads 11 in their interior under pressure.

FIG. 5 shows three representative views, elevated, horizontal projection, and profile, of connection element 15 between the head and handle of the unit, with shaping by means of a body of trapeziform cross section and cylindrical upper end 16, which centrally to same incorporates a small circumferential offset 17, in which a similar protuberance of the connection of the unit body is connected. The lower base of said part contains extended ribs 18 for connection over the actual shaving head. A prolonged opening along the entire length of said body is observed at position 19, used to facilitate the shaping of the base and therefore penetration into the shaving head, its exiting being prevented by adoption of side ribs 18, which will remain positioned when pressure exerted on the base is released. The ribs used as a means for positioning said part to the shaving head and which prevent inadequate or undesired shifts of said part in relation to the head are observed at position 20.

FIG. 6 represents the connection system between head and body of the shaving unit by means of hollow cylindrical part 4 fastened to body base 1, whereas cylindrical end 16 of the interconnection part of FIG. 5 to shaving head 11 is connected in the interior of said cylindrical portion, small space 21 existing at the side in said connection being intended to facilitate small angular variations of the head in relation to the handle for adaptation to the individual face to be shaved.

FIG. 7 represents a second possible form of connection between body base and shaving head 11, same being formed by end 22 bifurcated into two arms 23 forming a certain angle which will be introduced into corresponding side ribs 24, which the shaving head will later possess.

What is claimed is:

1. Shaving unit and shaving tools, all incorporated in the same element of small dimensions, comprising: an elongated hollow main body having opposite open ends in whose interior, and introduced through each of its opposite ends, are located separate lather spray and aftershave or lotion spray containers, both covered at the respective opposite ends thereof by closure caps, wherein the closure cap for said lather spray container includes an elongated side extension which projects parallel to said main body with a spaced elongated area between said main body and said side extension for attachment to clothing, whereas said lather spray closure cap possesses elongated grooves on both sides of said side extension parallel to the main body with the function for the accommodation of shaving heads, and a concave mirror is arranged in its anterior plane zone for observation of areas to be shaved, said elongated main body having an attachment element for shaving heads disposed toward an end above that which is connected to the lather spray container, wherein connection between said main body and a shaving head is achieved by means of a male-female connection with said attachment element comprising a hollow cylindrical element having a cross opening secured as an extension of the end of the main body for introduction therethrough of a mating body which is a connection member between said attachment element and a shaving head, said connection member having a body of trapeziform cross section with a cylindrical upper end which centrally incorporates a small circumferential offset in which a similar boss of the attachment element is connected, extended ribs being located at a lower base of said connection member for connection over said shaving head, whereas said connection member has a recessed portion extending over the entire length of said connection member which facilitates penetration into said shaving head.

2. Shaving unit and shaving tools in accordance with claim 1, wherein a recess exists in the male-female connection member adjacent the cylindrical end thereof between a shaving head and said main body, which permits small angular variations of said shaving head (11) for a better adaption to the body area to be shaved.

3. Shaving unit and shaving tools in accordance with claim 2, wherein the cylindrical end in the male-female connection member between said shaving head and said main body possesses a circumferential offset in an intermediate zone, in which a projecting flange is positioned from said hollow cylindrical attachment element in order for said fastening in the use of the unit to be facilitated by means of the positioning of said shaving head and attachment element, preventing undesired separation of same.

4. Shaving unit and shaving tools, all incorporated in the same unit comprising: an elongated hollow main body of cylindrical cross section having opposite open ends in whose interior, and introduced through each of its opposite ends, are located separate shaving lather and aftershave or lotion spray containers with dispensing valves thereof projecting outwardly from opposite open ends of said main body, both dispensing valves covered at the respective opposite ends thereof by removable closure cap means, wherein the closure cap means of said lather spray dispensing valve includes an elongated side extension which projects parallel to said main body providing a spaced elongated area between said main body and said side extension for attachment to clothing, said elongated side extension having carrying means for at least one shaving head and mirror means arranged for observation of areas to be shaved, said elongated main body having attachment means for shaving heads disposed toward an end above that from which the lather spray dispensing valve projects.

5. Shaving unit and shaving tools in accordance with claim 4, wherein said main body retains each of said lather spray and aftershave containers therein for dispensing operation thereof and said main body is of a size to serve as a handle for a shaving head to use in shaving a body area to be shaved.

6. Shaving unit and shaving tools in accordance with claim 5, wherein said attachment means for shaving heads is achieved by male-female connection means which permits angular variations of said shaving head for adaptation to the body area to be shaved.

* * * * *